US012767391B2

(12) United States Patent
Bassi et al.

(10) Patent No.: US 12,767,391 B2
(45) Date of Patent: Oct. 20, 2026

(54) CLOSING CAP FOR A CONTAINER

(71) Applicant: SACMI COOPERATIVA MECCANICI IMOLA SOCIETA' COOPERATIVA, Imola (IT)

(72) Inventors: Vittorio Bassi, Faenza (IT); Alessandro Falzoni, Imola (IT)

(73) Assignee: SACMI COOPERATIV A MECCANICI IMOLA SOCIETA' COOPERATIVA, Imola (IT)

( * ) Notice: Subject to any disclaimer, the term of this patent is extended or adjusted under 35 U.S.C. 154(b) by 239 days.

(21) Appl. No.: 18/704,709

(22) PCT Filed: Nov. 7, 2022

(86) PCT No.: PCT/IB2022/060680
§ 371 (c)(1),
(2) Date: Apr. 25, 2024

(87) PCT Pub. No.: WO2023/079519
PCT Pub. Date: May 11, 2023

(65) Prior Publication Data

US 2026/0109517 A1 Apr. 23, 2026

(30) Foreign Application Priority Data

Nov. 8, 2021 (IT) ..... 102021000028385

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01)

(58) Field of Classification Search
CPC ..... B65D 55/16; B65D 41/3428; B65D 2401/30; B65D 2251/04; B65D 2251/1008
(Continued)

(56) References Cited

U.S. PATENT DOCUMENTS 11,697,534 B2 7/2023 Bassi et al.
2015/0129534 A1* 5/2015 Falzoni ..... B65D 41/0421 215/316
(Continued)

FOREIGN PATENT DOCUMENTS

ES 1232089 7/2019
FR 3108317 9/2021
(Continued)

OTHER PUBLICATIONS

International Search and Written Opinion, issued in PCT/IB2022/060680 on Mar. 28, 2023, 11 pages.

*Primary Examiner* — Laura E. Parker
(74) *Attorney, Agent, or Firm* — Chrisman Gallo Tochtrop LLC

(57) ABSTRACT

A closing cap for a container that includes a lateral wall and a transversal wall positioned at one end of the lateral wall, a separating line on the lateral wall to define a retaining ring, which is configured to remain anchored to the neck of the container, and a closing element removably engageable with the neck to open or close the container. The separating line extends around the axis and is circumferentially interrupted to define a joining zone that extends circumferentially for a first angular portion, in which the retaining ring and the closing element are joined. The lateral wall has a first and second cuts and a projection which projects from the lateral wall, wherein the first and the second cuts extend circumferentially within a second angular portion which is contained in the first angular portion, the projection being between the first and the second cuts.

21 Claims, 10 Drawing Sheets

(58) Field of Classification Search
USPC ..... 215/243
See application file for complete search history.

(56) References Cited

U.S. PATENT DOCUMENTS

| | | | | |
|---|---|---|---|---|
| 2021/0229873 | A1* | 7/2021 | Berroa García ... | B65D 41/3447 |
| 2022/0204228 | A1 | 6/2022 | Bassi et al. | |
| 2022/0340339 | A1* | 10/2022 | Naumann ..... | B65D 41/3447 |
| 2022/0340340 | A1 | 10/2022 | Bassi et al. | |
| 2023/0034260 | A1* | 2/2023 | Omori ..... | B65D 55/16 |
| 2024/0002116 | A1* | 1/2024 | Berroa Garcia ..... | B65D 55/16 |
| 2024/0025095 | A1* | 1/2024 | Scherer ..... | B65D 55/16 |

FOREIGN PATENT DOCUMENTS

| | | | | |
|---|---|---|---|---|
| FR | 3108317 | A3 * | 9/2021 | ..... B65D 55/16 |
| WO | 2021014290 | | 1/2021 | |
| WO | 2021053488 | | 3/2021 | |
| WO | 2021148706 | | 7/2021 | |

* cited by examiner

Fig.3
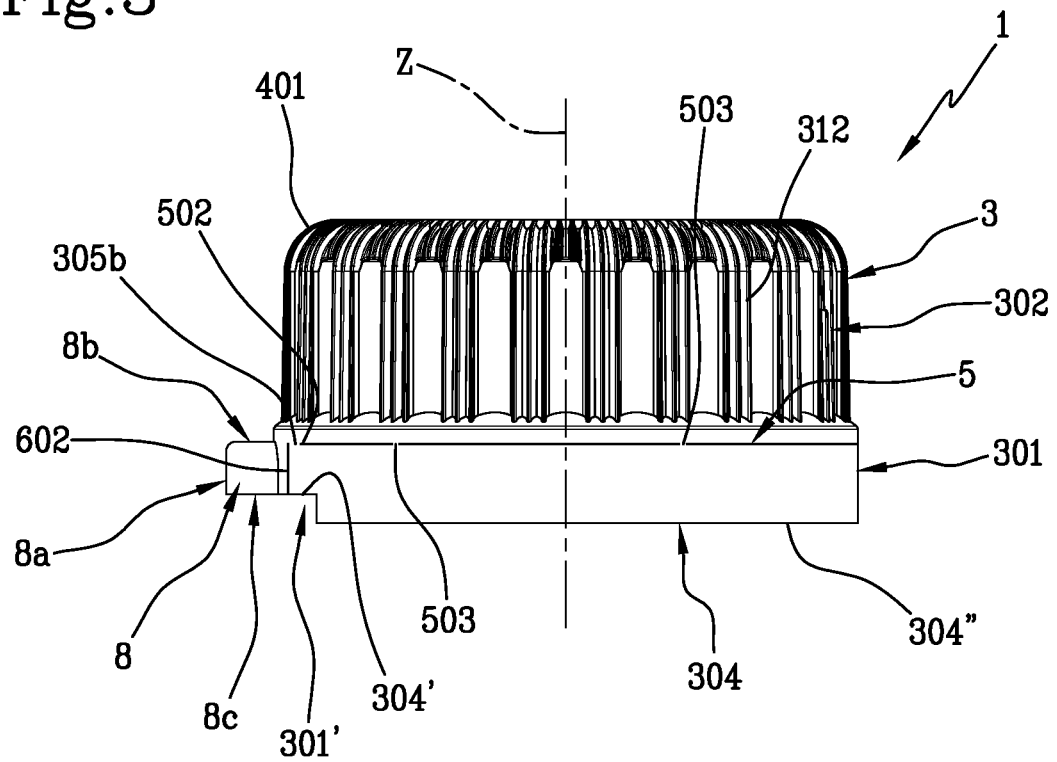
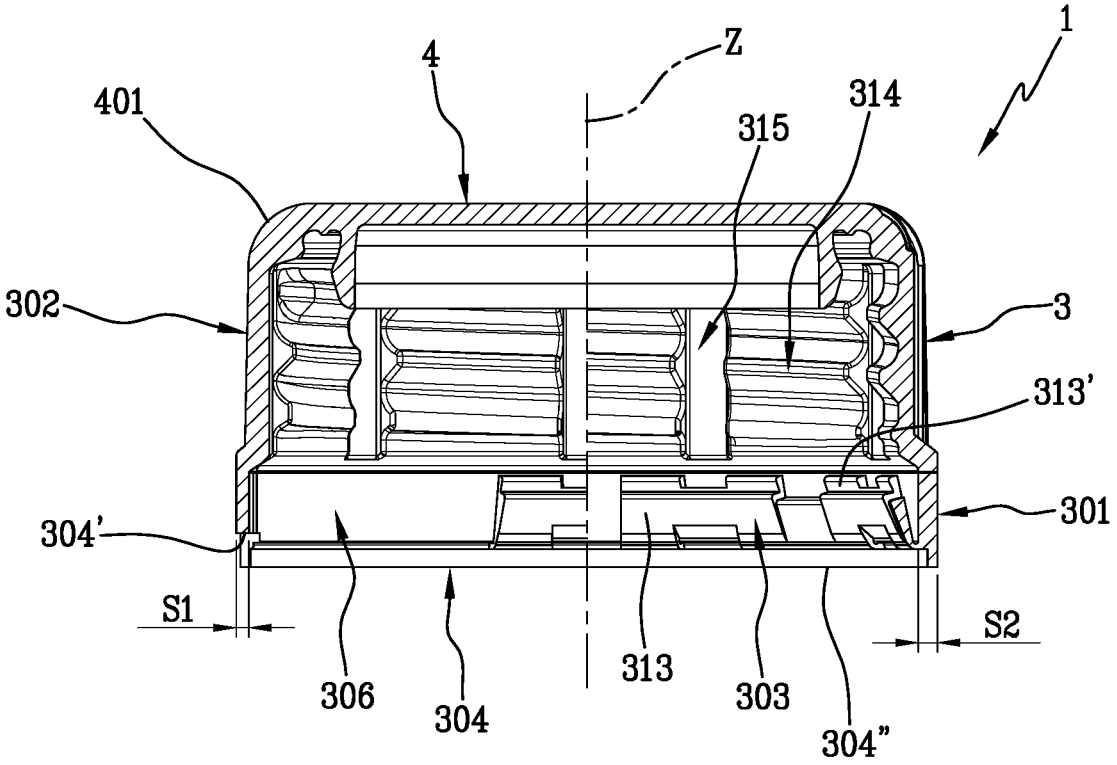
Fig.4

Fig.5
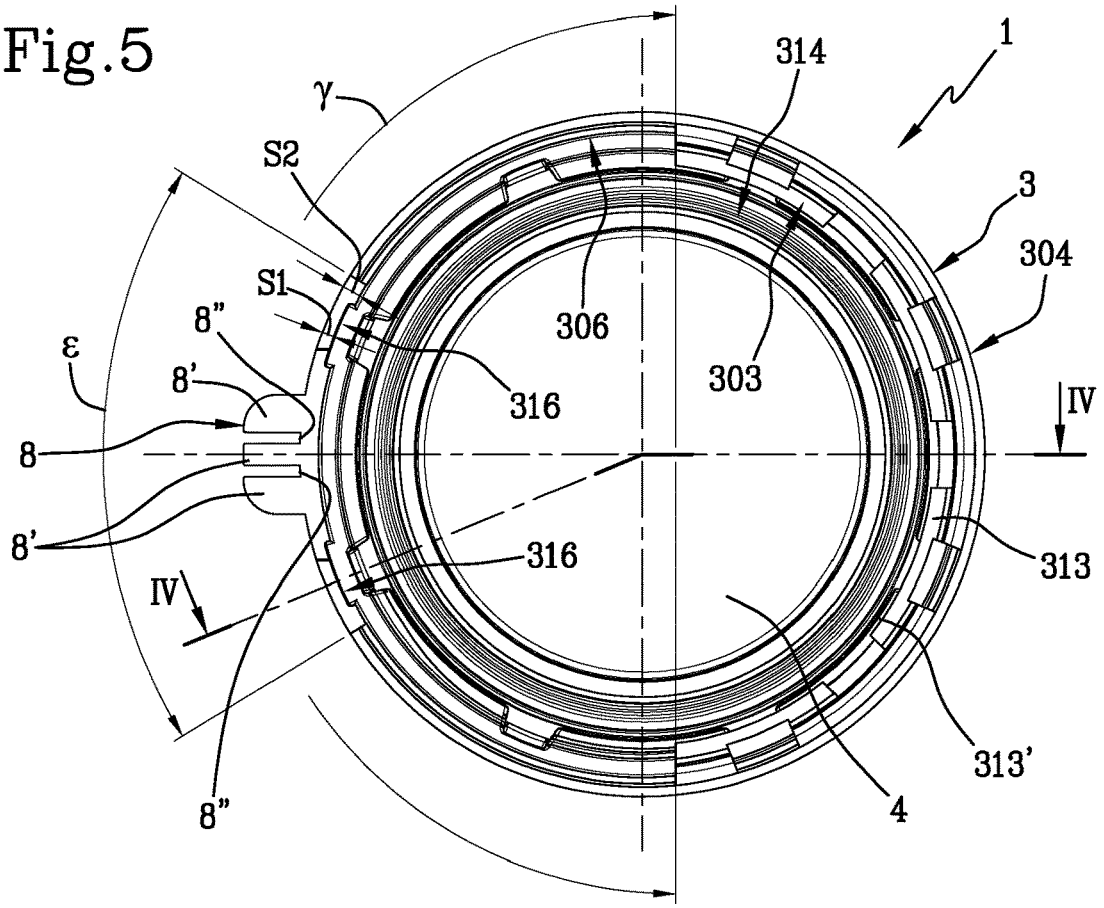
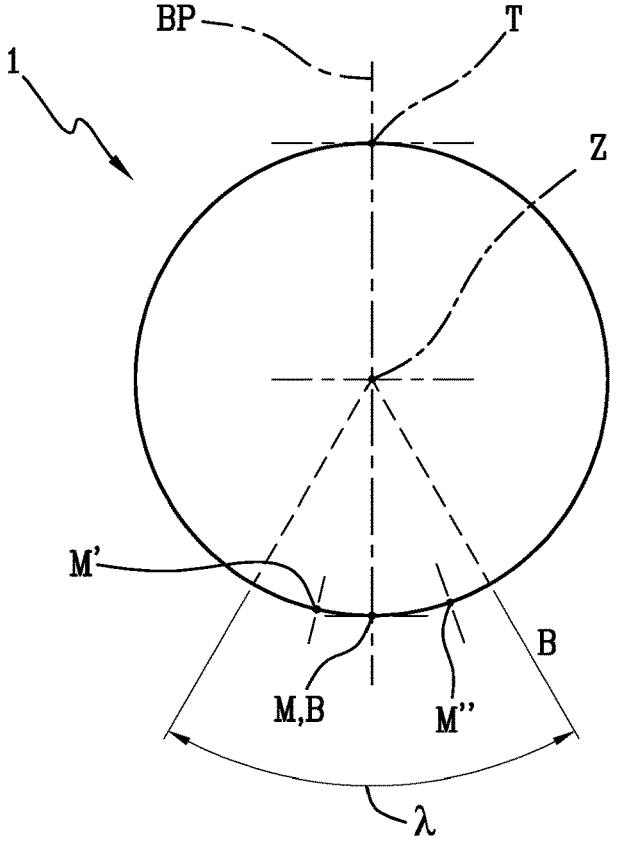
Fig.6

CLOSING CAP FOR A CONTAINER

The invention relates to a closing cap for a container.

In particular, the invention relates to a cap provided with a retaining ring, joinable to a container neck, the cap also being provided with a closing element which, after opening, remains connected to the retaining ring. The cap according to the invention is particularly, but not exclusively, suitable for being applied on containers such as bottles intended to contain liquid substances.

There are prior art caps for containers comprising a cup-shaped body provided with a transversal wall and with a lateral wall extending around an axis, which are typically made of plastic material and are provided with a separating line made in the lateral wall to define a retaining ring and a closing element, removably engageable with the neck, so as to open or close the container. The retaining ring is configured to remain anchored to a neck of the container. The closing element is provided with an inner thread structure, suitable for engaging with an outer thread structure of the neck, to allow the cap to be unscrewed from and screwed back onto the neck.

Along the separating line breakable bridges are present, which are intended to be broken the first time the cap is opened. In fact, when the cap is opened for the first time and is unscrewed from the neck of the container, the closing element separates from the retaining ring along the separating line following breaking of the breakable bridges and in this way the retaining ring can remain joined to the neck of the bottle, while the closing element can be separated from the container and, then, can be screwed back onto the neck. The shape of the separating line determines the way in which the closing element and the retaining ring separate following the first opening of the cap itself.

In the caps in which the separating line is configured to extend circumferentially for the entire lateral wall, the closing element completely detaches from the retaining ring, at the moment of first opening of the cap. With these caps it may be the case that the user throws the closing element on the ground, deliberately or accidentally, whilst the container, together with the retaining ring joined to it, is correctly thrown in a waste bin. Obviously, this is unwanted behaviour.

To overcome this problem caps have been proposed in which the separating line is circumferentially interrupted to leave the closing element joined to the retaining ring, in the cap open condition, in a joining zone.

In these types of caps, it is also necessary to use special devices in order to ensure that the closing element, in the open condition, remains locked in the same position when a user tips the bottle to pour its contents, so as to prevent the cap from being able to rotate and fall due to gravity, interfering with user dispensing of said contents.

Document WO2021014290A1 describes a cap for a container having a lateral wall provided with a separating line configured to define a retaining ring, suitable for remaining anchored to a stop ring of a neck of the container, and a closing element, suitable for opening, or closing the container, wherein the separating line is circumferentially interrupted so that the closing element and the retaining ring remain joined in a joining portion, and wherein the retaining ring comprises a first connecting band and a second connecting band, which extend from circumferentially opposite zones of the joining portion and a tab, interposed between the first connecting band and the second connecting band.

Document WO2021148706 describes a capping device for a container comprising a cap, a lower ring and a hinge device, which includes two strips, which allow the cap to be joined to the lower ring. The lower ring is axially retained on a neck of the container and comprises a first sector provided with hooking elements configured to operate in conjunction with a hooking collar of the neck and a second sector, without the hooking elements. In the first sector, a zone diametrically opposed to the second sector is also without the hooking elements, which in contrast are present in two further zones, opposite each other, adjacent to the second sector.

Document FR3108317 shows a cap for a container provided with a body, a tamper-evident ring and two connecting arms connected to the tamper-evident ring and to the body, wherein the cap comprises a locking element comprising a first part and a second part, shaped to be able to engage with each other to allow the body of the cap to be held in an open position.

Document ES1232089U and document WO2021053488 contain generic information in the sector of closing caps for containers.

One aim of the invention is to improve the prior art caps, in particular the caps comprising a retaining ring intended to remain joined to a neck of the container and a closing element which can removably engage with the neck to allow a user to open or alternatively close the container.

Another aim is to provide a cap for a container, provided with a closing element which remains connected to the retaining ring, which additionally can be made in a simple and inexpensive way.

A further aim is to provide a cap for a container, provided with a closing element which remains connected to the retaining ring, which additionally can remain stably locked in position after opening.

Another further aim is to provide a cap for a container, provided with a closing element which remains connected to the retaining ring, which additionally is easy to screw back onto the neck during the passage from the open condition to the closed condition.

Accordingly the invention provides a cap for a container according to claim 1 and the claims dependent on it.

In detail, according to the invention, a closing cap for a container is provided, comprising a lateral wall extending around an axis and a transversal wall positioned at one end of the lateral wall, a separating line being provided on the lateral wall to define a retaining ring, which is configured to remain anchored to the neck of the container, and a closing element removably engageable with the neck, so as to open or close the container. The separating line extends around the axis and is circumferentially interrupted to define in the lateral wall a joining zone, which extends circumferentially for a first angular portion, in which the retaining ring and the closing element are joined. The lateral wall comprises a first cut, a second cut and a projection which projects from the lateral wall, wherein the first cut and the second cut extend circumferentially within a second angular portion which is contained in the first angular portion, the projection being circumferentially positioned between the first cut and the second cut. The retaining ring and comprises a retaining portion and a free portion which extend as far as a free edge, the retaining portion being configured to internally engage with a stop ring of the neck, during a passage from a closed condition to an open condition of the closing element; the free portion being configured to allow an axial movement at least of the second angular portion of the retaining ring during said passage.

Advantageously, the cap is simple to make since the mould in which the cap is made can be suitably shaped, without causing excessive complications in the mould itself, thanks to the fact that the projection can be made with a mould which has an undercut zone.

Even the cuts between which the projection is positioned can be made by simple cutting operations, after making the cap, or by moulding.

It should be noticed that, according to one embodiment, the retaining portion is made as an engaging element shaped like an engaging wall, bent around the free edge and provided with a plurality of projecting elements, shaped like flaps, whose length is such that they can engage with the stop ring, during the passage to the open condition of the closing element. In contrast, the free portion is delimited by the free edge and there is no wall projecting from the free edge itself.

In this way, during the passage from the closed condition to the open condition of the closing element, the free portion never engages with the stop ring and therefore the second angular portion between the first cut and the second cut can be moved axially when the user unscrews the cap from the neck and the joining zone, joined to the closing element, moves away from the retaining portion.

Thanks to the free portion, the closing element can disengage from the neck of the container.

Advantageously, thanks to the first cut and to the second cut, the second angular portion defined between them can deform, to allow the closing element to rotate during the passage from the closed condition to the open condition so that, in the open condition, the closing element is rotated relative to the neck and the projection is resting on it.

Thanks to the projection, it is possible to stably rest the closing element on the neck, so that it cannot rotate and it remains locked in the same position even when a user tips the bottle to pour its contents.

According to one embodiment, the retaining ring comprises a recess which extends circumferentially at least in the second angular portion. In this way there may be a reduced distance between the projection and the free edge and this is advantageous since it makes it easier for a user to place the projection resting on the neck despite, in some types of cap, it being preferable for the projection to be positioned axially towards the transversal wall.

According to a further embodiment, the first cut and the second cut extend as far as the free edge and are formed by a cutting line passing through an entire thickness of the lateral wall, or they may comprise a breakable element. For example, the first cut and the second cut may be joined to the free edge respectively by a first breakable element and a second breakable element which are intended to break the first time the cap is opened. Alternatively, according to another embodiment, the first breakable element and the second breakable element may be positioned in other positions along the first cut and the second cut. In any case, a tab is defined, on which the projection is positioned, which allows even greater deformability of the second angular portion and allows efficient resting of the projection on the neck.

The invention can be better understood and implemented with reference to the accompanying drawings, which illustrate several example, non-limiting embodiments of it, in which:

FIG. 3 is a side view of the cap of FIG. 1;

FIG. 4 is a cross-section of the cap of FIG. 1, along a cross-section plane IV-IV of FIG. 5;

FIG. 5 is a view of the cap of FIG. 1 from a free edge side, opposite to a transversal wall, showing the cross-section plane IV-IV;

FIG. 6 is a schematic view of the cap of FIG. 1, seen from the transversal wall side, showing a median line M' of a joining zone, a first axis T and a second axis B, which are all three parallel to an axis Z around which a lateral wall of the cap is positioned;

With reference to FIGS. 1 to 12, the numeral 1 denotes a closing cap for a container 2, of which container only a neck 201 is shown. The container 2 is shaped, for example, like a bottle intended to contain a liquid substance such as a beverage.

It should be noticed that elements common to the various embodiments will be labelled with the same reference numbers.

The cap 1 is made of polymeric material. Any polymeric material suitable for moulding may be used to obtain the cap 1.

Figure 1:
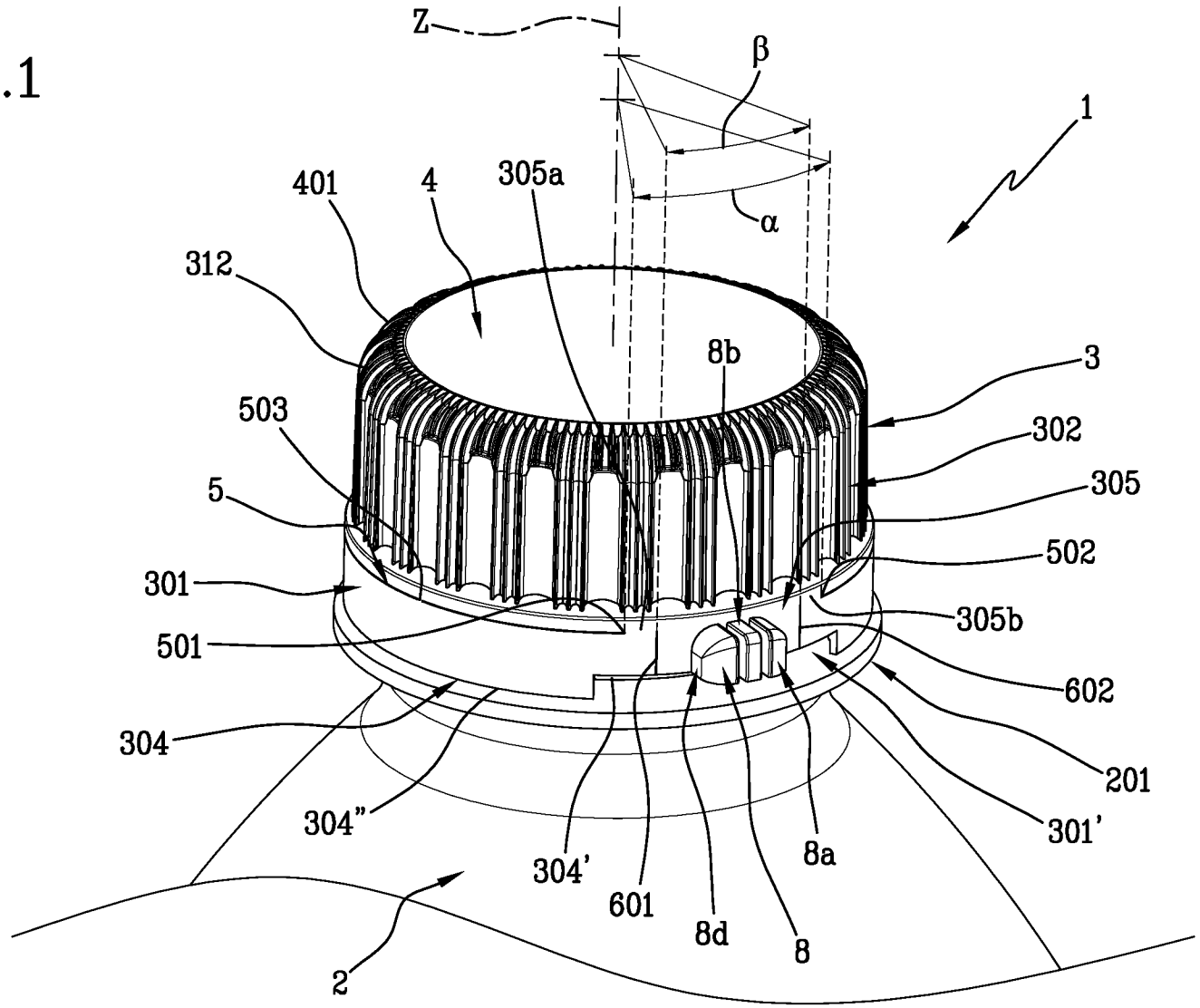
FIG. 1 is a perspective side view of a closing cap for a container according to the invention, in a closed condition, in which the cap is joined to a neck of a container and comprises a closing element and a retaining ring, joined to each other in a joining zone, a projection and a pair of cuts, between which the projection is positioned.
Figure 2:
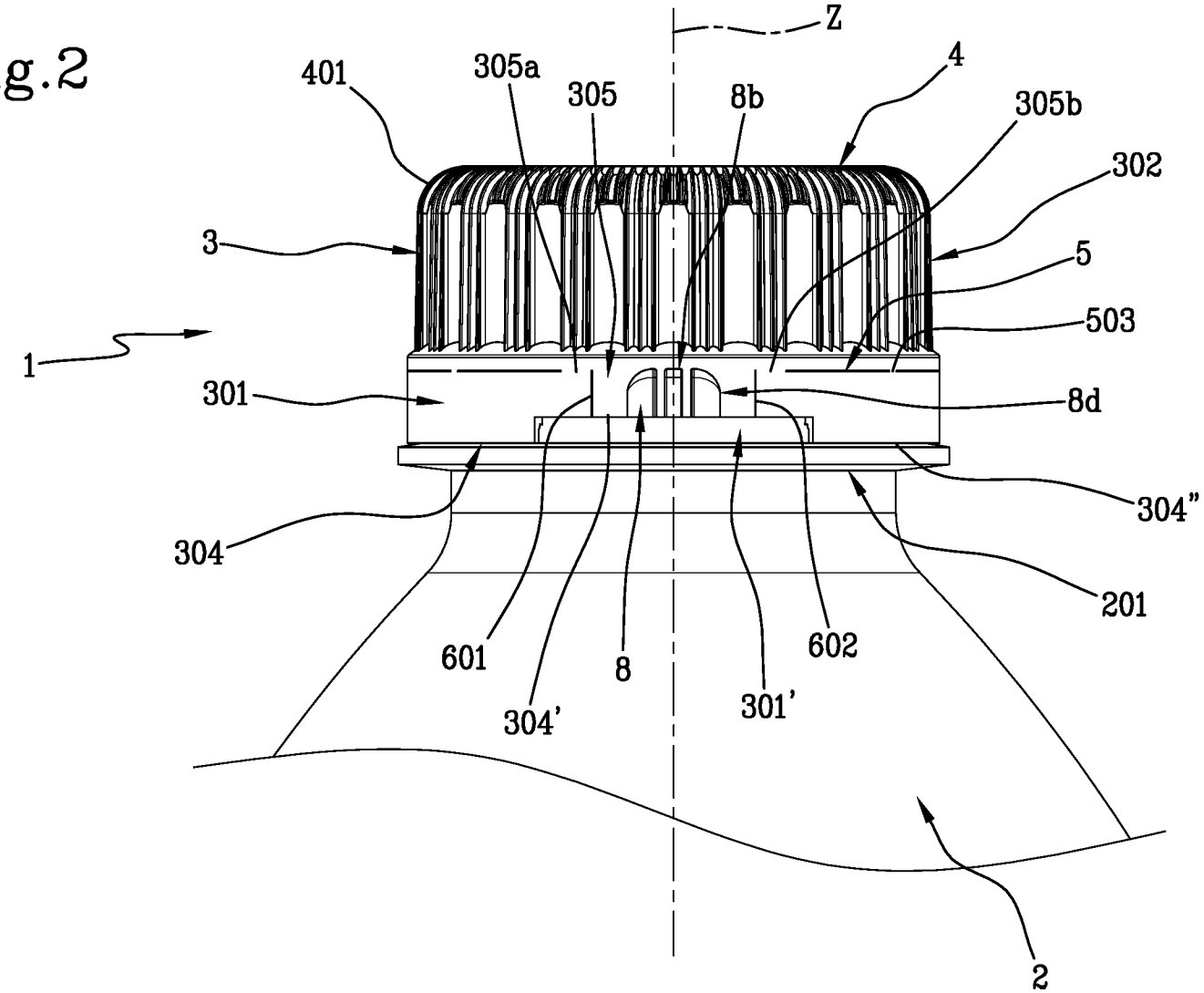
FIG. 2 is a front view of the cap of FIG. 1, joined to the neck of the container.

The cap 1 is shown in FIG. 1 in a closed condition in which the cap 1 is found when it leaves a cap production line and is applied on the container 2.

The cap 1 comprises a lateral wall 3 which extends around an axis Z, and a transversal wall 4 positioned at one end of the lateral wall 3, so as to close that end. The transversal wall 4 extends transversally, in particular perpendicularly, to the axis Z.

The axis Z is a central axis, of symmetry for the lateral wall 3.

The transversal wall 4 may be flat, even though other shapes are theoretically possible. In the example shown, the transversal wall 4 has a substantially circular shape in plan view.

The lateral wall 3 and the transversal wall 4 define a cup-shaped body suitable for receiving an end portion of the neck 201 of the container 2, so that the cap 1 can close the self-same container 2.

In particular, the lateral wall 3 is connected to the transversal wall 4 by a connecting zone 401, which may be shaped, in cross section, like a bevelled edge or a circular connector.

The cap 1 comprises a separating line 5, which is provided on the lateral wall 3 to define a retaining ring 301, which is configured to remain anchored to the neck 201 of the container 2.

The separating line 5, on the lateral wall 3, defines not just the retaining ring 301, but also a closing element 302 removably engageable with the neck 201, so as to open or close the container 2. The closing element 302 is engageable for closing a supply opening 202 of the container 2, shown in FIG. 11.

The separating line 5 extends around the axis Z and is circumferentially interrupted to define in the lateral wall 3 a joining zone 305, which extends circumferentially for a first angular portion α, in which the retaining ring 301 and the closing element 302 are joined.

The separating line 5 extends in a separating plane positioned transversally, in particular perpendicularly, to the axis Z. It should be noticed that the retaining ring 301 and the closing element 302 are positioned on opposite sides of the separating line 5.

In detail, the separating line 5 extends between a first end 501 and a second end 502.

Along the separating line 5 a plurality of breakable bridges 503 may be provided, which connect the retaining ring 301 to the closing element 302.

The breakable bridges 503 are intended to be broken the first time the cap 1 is brought into the open condition, to signal that the container 2 is no longer whole. In this way, the closing element 302 can separate from the retaining ring 301 along the separating line 5.

The retaining ring 301 comprises a retaining portion 303, which is configured to internally engage with a stop ring 206 (FIG. 11) of the neck 201, in such a way as to remain anchored to the self-same neck 201 during a passage from a closed condition to an open condition of the closing element 302.

Therefore, the retaining portion 303 is configured to keep the retaining ring 301 anchored to the neck 201 of the container 2.

The stop ring 206 is an annular protuberance, which projects from an outer surface 204 of the neck 201 in a plane placed transversally to the axis Z.

The lateral wall 3 may be provided, on an outer surface thereof, with a plurality of knurling lines 312, extending parallel to the axis Z and suitable for facilitating gripping of the cap 1 by the user or by the capping machine which applies the cap 1 on the container 2 to be closed.

The knurling lines 312 may be positioned in the closing element 302, but may also continue in the connecting zone 401 and/or in the retaining ring 301.

It should be noticed that the lateral wall 3 of the cap 1 comprises a cylindrical portion which extends as far as the connecting zone 401, on which the knurling lines 312 are made, a widened portion with diameter greater than the cylindrical portion, which extends as far as a free edge 304 of the retaining ring 301 and a connecting zone positioned between the cylindrical portion and the widened portion. The knurling lines 312 are not provided on the connecting zone and on the widened portion, which is externally delimited by an outer surface which is smooth, that is to say, free of knurling lines 312. However, that is not necessary, since the knurling lines 312 could also extend on the connecting zone and on the widened portion.

The knurling lines 312 may also be interrupted to highlight a mark, not illustrated, which is optically recognisable relative to the knurling lines 312, so that optical inspection systems for the cap 1, which are present in cap 1 production lines, can optically tell the difference between the mark and the knurling lines 312.

Figure 7:
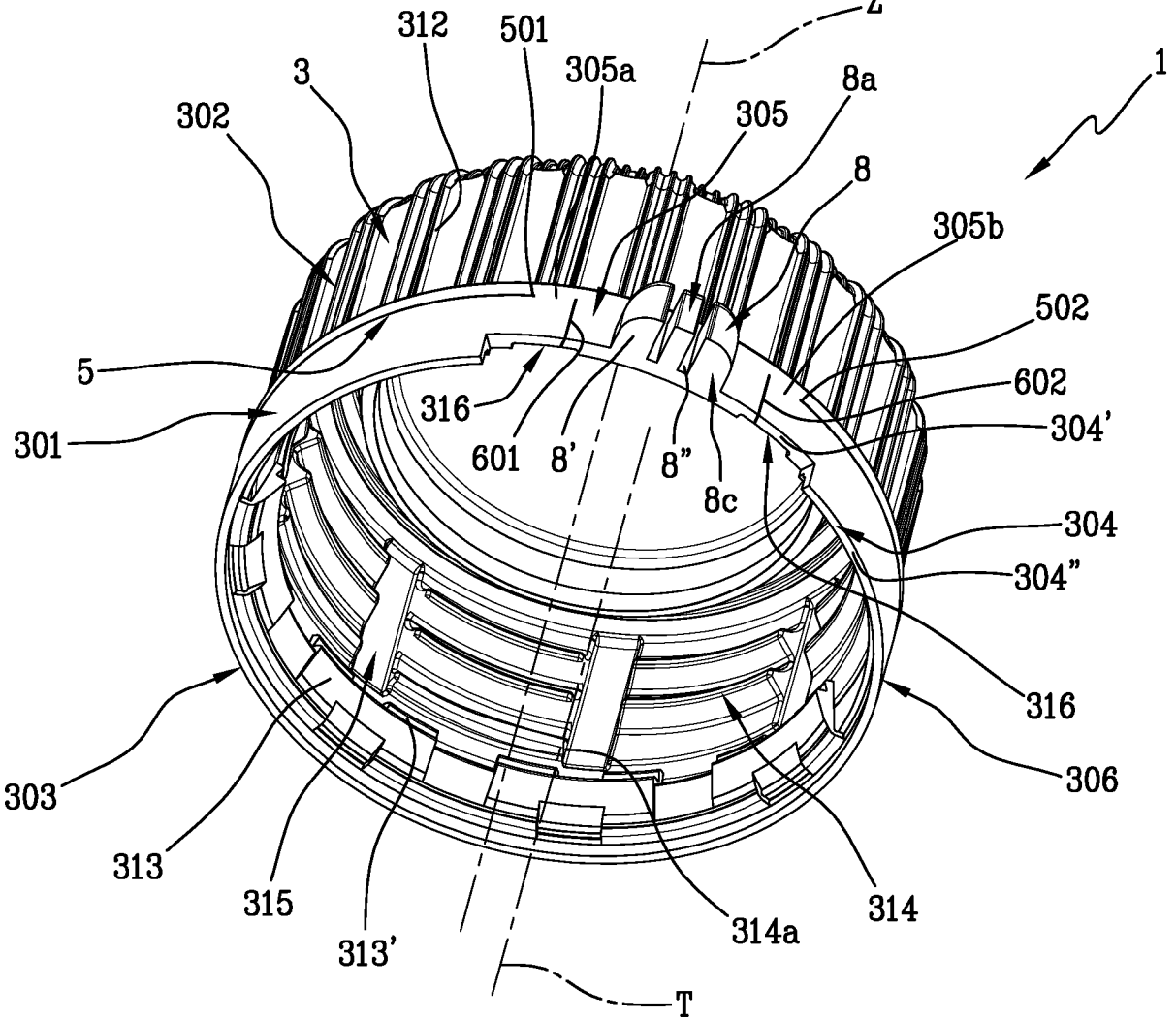
FIG. 7 is a perspective view of the cap of FIG. 1 showing the first axis T and the axis Z.
Figure 8:
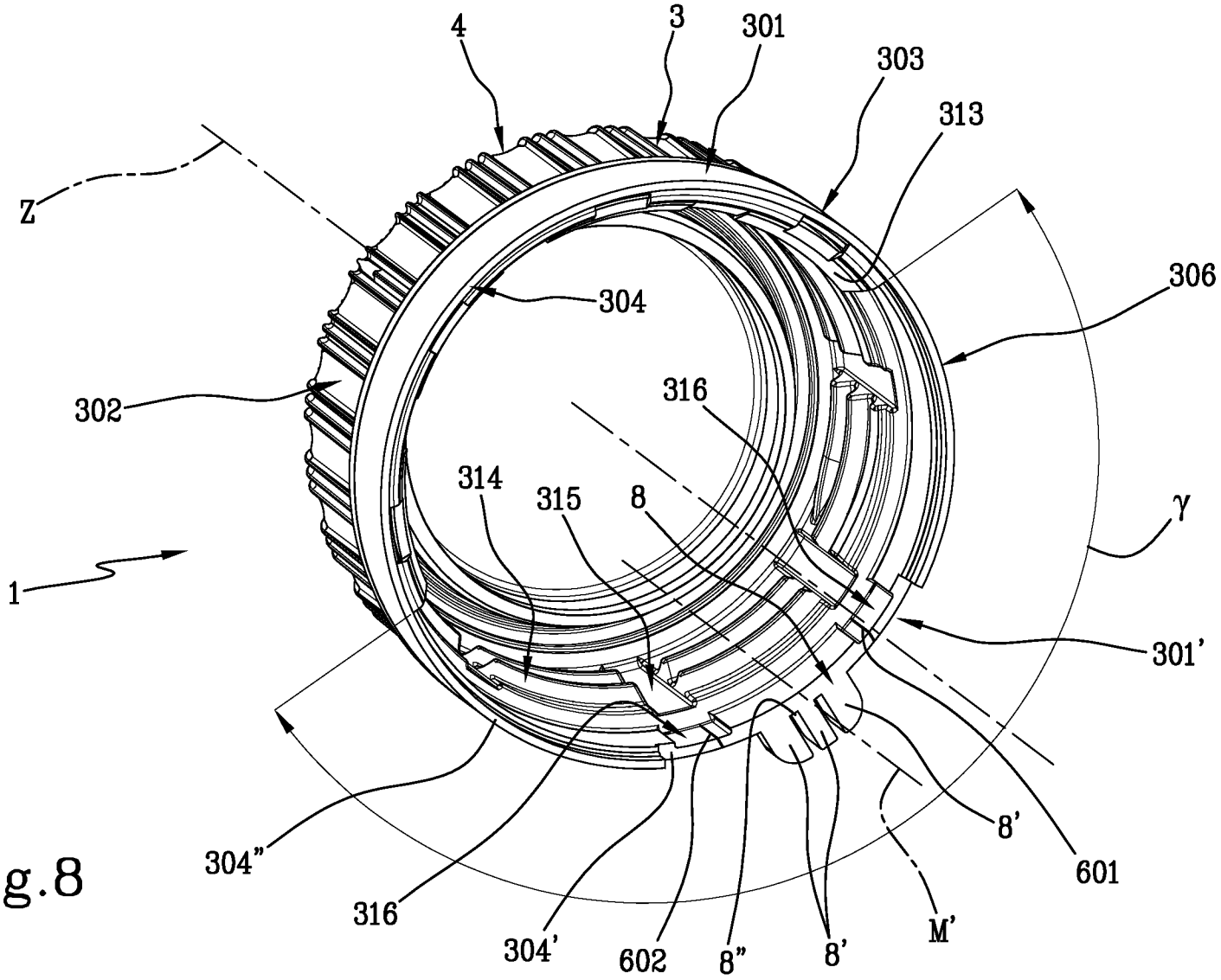
FIG. 8 is another perspective view of the cap of FIG. 1, showing the median line M' and the axis Z.

The cap 1 additionally comprises an inner thread structure 314 shown at least in FIGS. 4, 7 and 8, positioned on the inside of the lateral wall 3 of the closing element 302 for removably coupling the closing element 302 to the neck 201 of the container 2.

Figure 11:
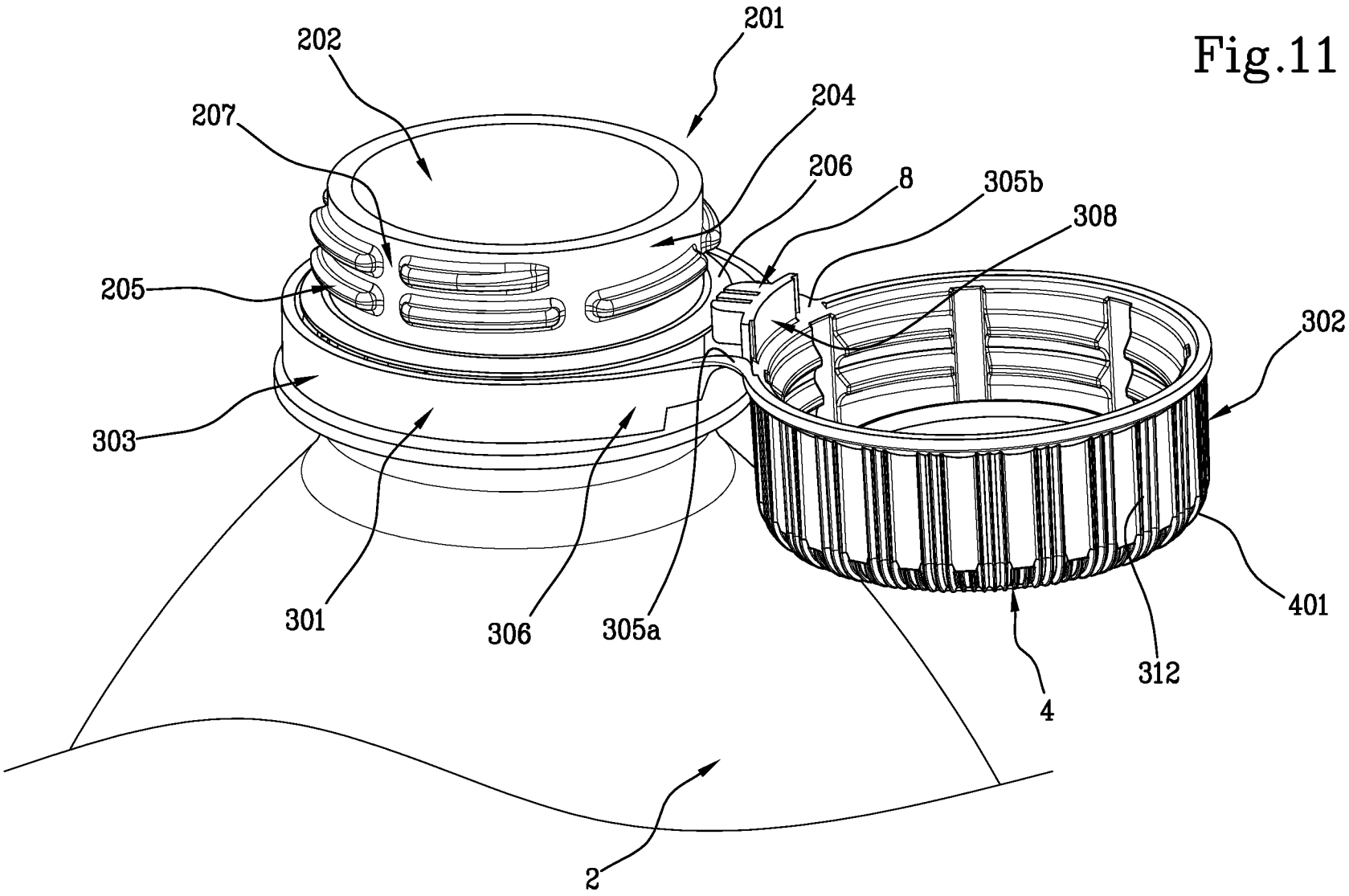
FIG. 11 is a perspective view of the cap of FIG. 1, joined to the container, in the open condition in which the projection is resting on the neck.

In detail, the inner thread structure 314 is intended to couple to an outer thread structure 205 of the neck 201, shown in FIG. 11.

The inner thread structure 314 extends in a spiral around the axis Z of the cap 1 starting from a start 314*a*, shown in FIG. 7.

The start 314*a* of the inner thread structure 314 is positioned near the separating line 5.

It should be noticed that the inner thread structure 314 comprises at least two venting grooves 315 which extend axially and interrupt the inner thread structure 314.

The cap 1, having the venting grooves 315 is particularly suitable for use as a closure for containers 2 intended to contain sparkling beverages, or in any case products which are pressurised or in which pressure may build up over time (for example fermentable beverages).

In fact, if the inner thread structure 314 of the cap 1 and the outer thread structure 205 of the neck 201 are provided respectively with the plurality of venting grooves 315 and with a plurality of venting channels 207, which extend axially and which pass through and interrupt the respective thread structures, a gradual release of the gas contained in the container 2 during removal of the cap 1 from container 2 can be guaranteed. In fact, even if the inner thread structure 314 is still engaged by the outer thread structure 205, preferential zones can be created for the discharge of the pressurised gas from the container 2 when a venting groove 315 of the cap 1 faces a venting channel 207 of the neck 201. In this way, a user can safely remove the cap 1 from the container 2, at the end of disengaging of the closing element 302 from the outer thread structure 205 of the neck 201, since a residual pressure of the gas inside the container 2, before the inner thread structure 314 of the cap 1 has completely disengaged from the outer thread structure 205 of the neck 201, is zero, or in any case minimal.

The inner thread structure 314 extends from the start 314*a* as far as an end (not illustrated) positioned near the transversal wall 4.

It should be noticed that the inner thread structure 314 may be single-threaded, that is to say, may comprise a single spiral curved thread which extends from the start 314*a* to the end, or it may be double-threaded, or triple-threaded, that is to say, it may comprise respectively two, or three separate spiral curved threads, each of which may extend continuously starting from a respective origin to a respective destination.

If the inner thread structure 314 is at least double-threaded, the start 314*a* of the inner thread structure 314 coincides with a first origin of the first thread, or with a second origin of the second thread, that is to say, with the origin positioned nearest to the separating line 5.

The retaining ring 301 also comprises a free portion 306.

The retaining portion 303 and the free portion 306 extend as far as a free edge 304 of the retaining ring 301. In detail, the retaining portion 303 and the free portion 306 extend circumferentially around the entire retaining ring 301.

The lateral wall 3 comprises a pair of cuts, that is to say, a first cut 601 and a second cut 602, and a projection 8 which projects from the lateral wall 3 and is configured to rest on the neck 201 in the open condition.

The first cut 601 and the second cut 602 extend circumferentially within a second angular portion β which is contained in the first angular portion α defined by the joining zone 305. The projection 8 is circumferentially positioned between the first cut 601 and the second cut 602.

The free edge 304 delimits the retaining ring 301 on the opposite side to the transversal wall 4 and, in other words, the retaining portion 303 and the free portion 306 are lower portions of the retaining ring 301, and therefore of the cap 1, when the cap 1 is joined to the container 2.

The free portion 306 is configured to allow an axial movement along an axis parallel to the axis Z at least of the second angular portion β of the retaining ring 301 during the passage from the closed condition to the open condition. Thanks to the free portion 306, the closing element 302 can disengage from the neck 201 of the container 2 and in this way, in the open condition, the closing element 302 can be rotated and the projection 8 can be positioned resting on the neck 201.

Thanks to the joining zone 305, the closing element 302 is stably kept joined to the retaining ring 301 and therefore to the neck 201 of the container 2 in the open condition. That prevents the possibility of the closing element 302 being thrown on the ground separately from the container 2 and therefore allows the closing element 302, together with the container 2, to be correctly disposed of together with plastic material waste.

Thanks to the free portion 306 of the retaining ring 301, which allows the axial movement of the retaining ring 301 along an axis parallel to the axis Z at least in the second angular portion β in which the projection 8 and the pair of cuts 601, 602 extend, the retaining ring 301 can be lifted and angled axially, deforming at least in the second angular portion β, during the passaggio to the open condition while the retaining portion 303 continues to engage with the stop ring 206.

In this way, the user can disengage the closing element 302 from the neck 201.

It should be noticed that the free portion 306 extends circumferentially at least for a third angular portion γ, shown in FIG. 5, which contains the second angular portion β for the purpose of allowing the entire second angular portion β to perform said axial movement.

The user can unscrew the cap 1 from the neck 201 by engaging the inner thread structure 314 of the cap 1 with the corresponding outer thread structure 205 of the neck 201, despite the joining zone 305 keeping the closing element 302 connected to the retaining ring 301 and the retaining portion 303 remaining anchored to the stop ring 206 of the neck 201.

Thanks to the presence of the first cut 601 and of the second cut 602 and to the fact that the projection 8 extends circumferentially between them, the second angular portion β can bend and deform during the passage from the closed condition to the open condition of the closing element 302, to allow the closing element 302 to rotate in such a way that the projection 8 can rest on the neck 201.

Advantageously, the projection 8 being locked on the neck 201 in the open condition, the movement of the closing element 302 towards the supply opening 202 is stopped, since the projection 8 interferes with the stop ring 206, or with zones of the neck 201 near to it, and prevents the closing element 302 from freely rotating and falling due to gravity.

When the closing element 302 passes from the closed condition to the open condition, in this way the joining zone 305 defines a hinge band which keeps the closing element 302 connected to the neck 201, so that the closing element 302 can turn over and the projection 8 can rest on the self-same neck 201.

It should be noticed that the hinge band comprises a first hinge element 305*a* and a second hinge element 305*b* which are at least partly defined in the first angular portion α respectively between the first end 501 of the separating line 5 and the first cut 601 and the second end 502 of the separating line 5 and the and the second cut 602.

The first hinge element 305*a* and the second hinge element 305*b* are positioned at the sides of the respective cuts 601, 602 and are configured to deform in the open condition, when the closing element 302 is rotated and the projection 8 is resting on the neck 201.

As shown in FIGS. 1 to 11, it should be noticed that the retaining ring 301 comprises a recess 301' which extends circumferentially for a fourth angular portion ε, containing the second angular portion β, to facilitate resting of the projection 8 on the neck 201 in the open condition, in particular resting of an end wall 8*a* of the projection 8 on the neck 201.

It should be noticed that although the first angular portion α, the second angular portion β, the third angular portion γ and the fourth angular portion ε have been indicated using ordinal numbers, between those angular portions there is no hierarchical relationship, they are just different angular portions.

In other words, the recess 301' therefore extends at least between the first cut 601 and the second cut 602. In fact, the free edge 304 has a first stretch 304' which is recessed relative to a second stretch 304" since it is positioned nearer to the transversal wall 4 than the second stretch 304".

The first stretch 304' and the second stretch 304" extend circumferentially for the entire free edge 304.

The second stretch 304" is placed at a distance from the transversal wall 4 equal to the height of the cap 1 along an axis parallel to the axis Z.

The first stretch 304' may lie in a plane which is transversal to the axis Z, in particular perpendicular to the axis Z.

The first stretch 304' extends circumferentially for the fourth angular portion ε to define the recess 301' in the retaining ring 301.

It should be noticed that the first angular portion α, the second angular portion β, like the third angular portion γ and the fourth angular portion ε extend around the axis Z and have been shown in FIGS. 1 and 5. In this text, the term "angular portion" means a portion of the lateral wall 3 which extends circumferentially for the respective angle α, β, γ or ε, identified around the axis Z and shown in FIGS. 1 and 5 in a cross-section plane perpendicular to the axis Z.

In other words, the angular portion α, β, γ or ε is not necessarily identified by an angle which lies in a plane, but may even be identified by an angle defined between two planes and, in this case, the angular portion also extends axially, that is to say, parallel to the axis Z, for a predetermined dimension of the lateral wall 3.

This also applies to the reference angular portion λ, which will be described below.

As shown at least in FIGS. 1 and 3, the projection 8 has the end wall 8*a*, which is the outer end, an upper wall 8*b*, in the closed condition directed towards the transversal wall 4 and a lower wall 8*c*, in the closed condition directed towards the free edge 304. The projection 8 comprises a pair of lateral walls 8*d* on opposite sides which are respectively directed towards the first cut 601 and the second cut 602.

In other words, the presence of the recess 301' allows the projection 8 to be axially shifted towards the transversal wall 4, while at the same time keeping a reduced axial distance between the lower wall 8*c* of the projection 8 and the free edge 304. In fact, for some types of neck 201, that axial distance could obstruct resting of the end wall 8*a* of the projection 8 on the neck 201 when the closing element 302 is rotated and is in the open condition.

In detail, in FIGS. 1 to 11, it should be noticed that the projection 8 is delimited at the bottom by the first stretch 304', that is to say, extends as far as the free edge 304.

The lower wall 8*c* of the projection 8 therefore projects from the first stretch 304'.

Figure 12:
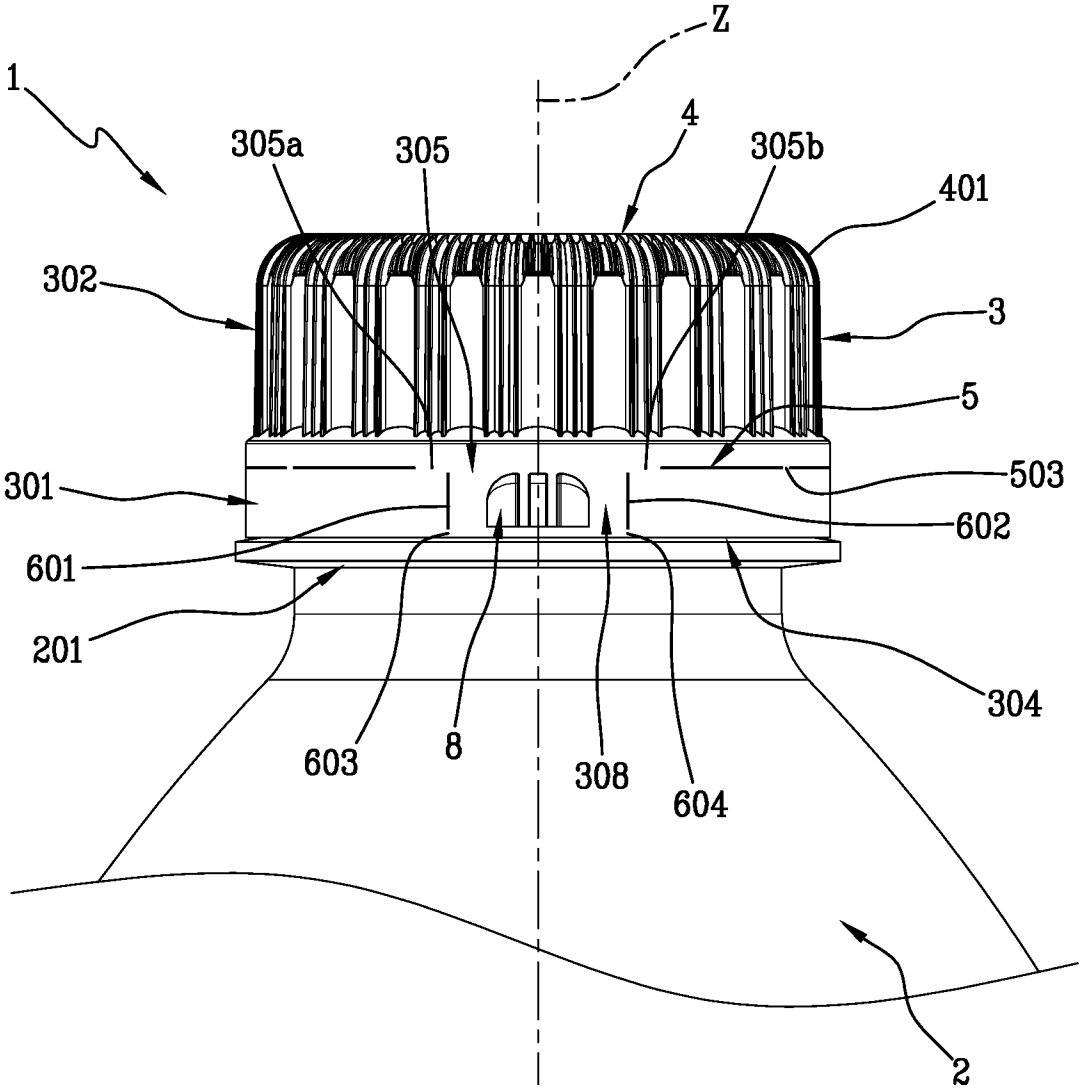
FIG. 12 is a variant of the cap of FIGS. 1 to 11, in which each cut of the pair of cuts, between which the projection is positioned, comprises at least one breakable element.

However, this is not necessary, and as will be seen in more detail below, the projection 8 may be near to the free edge 304 as shown in FIG. 12, but not delimited by it.

Advantageously, the size of the fourth angular portion ε is less than or equal to the third angular portion γ.

Therefore the size of the fourth angular portion ε(the recess 301') is greater than or equal to the second angular portion β (between the first cut 601 and the second cut 602) and less than or equal to the third angular portion γ (the free portion 306).

Advantageously, that allows an axial movement of the entire fourth angular portion ε of the retaining ring 301, in which the recess 301' is present, since the free portion 306 extends for the entire fourth angular portion ε.

The cuts, that is to say, both the first cut 601 and the second cut 602, are preferably formed by a cutting line passing through the lateral wall 3.

The cuts 601, 602 can be made after the step of making the cup-shaped body or, alternatively, the cuts 601, 602 can be made during the step of moulding the cap 1, by means of suitable shapes of the moulds with which the cap 1 can be made. In other words, despite the fact that according to a preferred embodiment the first cut 601 and the second cut 602 are obtained using cutting tools configured to cut the cup-shaped body, the first cut 601 and the second cut 602 can also be obtained thanks to the shape of the moulds. Therefore, the expression first cut 601 and second cut 602 means the presence of respective cut lines, irrespective of how these lines are obtained.

Advantageously, the cuts 601, 602 can extend as far as the free edge 304 to define a tab 308 between them within which the projection 8 is contained. However, that is not necessary, as indicated below.

If the recess 301' is present, as shown in FIGS. 1 to 11, since the recess 301' extends in the second angular portion β in which the cuts 601, 602 are present, the cuts 601, 602 extend as far as the recessed first stretch 304' of the free edge 304.

An end edge of the tab 308 is thereby defined by a section of the free edge 304 located between the cuts 601, 602, and in more detail by a section of the first stretch 304' itself.

According to one embodiment of the cap 1 shown in FIG. 12, the recess 301' may be absent. Between the free edge 304 and a lower wall 8*c* of the projection 8 there may be a predetermined distance, that is to say, it is not necessary for the projection 8 to be delimited by the free edge 304 and to project from it.

The absence of the recess 301' and/or the presence of the predetermined distance between the free edge 304 and the lower wall 8*c* of the projection 8 advantageously may also apply to the cap of FIGS. 1 to 11.

In the same way, as shown in FIG. 12, it may even be the case that each cut, of the first cut 601 and the second cut 602, may comprise a respective breakable element 603, 604, suitable for breaking when the cap 1 is opened for the first time.

According to one embodiment, shown in FIG. 12, between the free edge 304 and the first cut 601 there may be a first breakable element 603 present and between the free edge 304 and the second cut 602 there may be a second breakable element 604 present, those breakable elements 603, 604 being intended to break when the cap 1 is opened for the first time, to define the tab 308 within which the projection 8 is positioned.

The breakable elements 603, 604 on the respective cuts 601, 602 can provide a further indication to the user that the cap 1 has been opened.

Therefore, the tab 308 may be defined at the moment when the cap 1 is made, if the cuts 601, 602 extend as far as the free edge 304; or the tab 308 may be defined when the cap 1 is opened for the first time, if the cuts 601, 602 extend as far as the breakable elements 603, 604, which are present between the cuts 601, 602 and the free edge 304.

Alternatively, according to one embodiment not shown, each respective breakable element may be positioned along the respective first cut 601, or second cut 602, towards the transversal wall 4, for example half way along the first cut 601, or the second cut 602, but in any case at a distance from the free edge 304.

Thanks to the presence of the tab 308 and to the fact that the projection 8 is positioned inside the tab 308, the second angular portion β is given greater flexibility and therefore the projection 8 is more adaptable to the shape of the neck 201 of the container 2, thereby giving further stability to the resting of the projection 8 on the neck 201 in the cap 1 open condition.

It should be noticed that, as shown in the accompanying figures, the first cut 601 and the second cut 602 extend along a line parallel to the axis Z and are parallel to each other.

However, this may not be necessary since, for example, they may be angled and diverge towards the free edge 304. In this case the tab 308 may be shaped not like a rectangle but like a trapezium, whose larger base is positioned at the free edge 304.

Preferably, even if this is not necessary, along a line parallel to the axis Z the height of the first cut 601 and the second cut 602 is at least equal to a height of the projection 8. The cuts 601, 602 could, for example, have a height greater than that of the projection 8.

In detail, the first cut 601 and the second cut 602 are symmetrical relative to the projection 8, that is to say, relative to a median line M' of the projection 8, considered parallel to the axis Z.

It should be noticed that, as shown in FIGS. 1 to 12, the first cut 601, the second cut 602 and the projection 8 are contained in the retaining ring 301 since the upper ends of the first cut 601, of the second cut 602 and the upper wall 8*b* of the projection 8 are below the separating plane towards the free edge.

However, in one embodiment not shown, the first cut 601, the second cut 602 and/or the projection 8 may be at least partly contained in the closing element 302 and in the retaining ring 301 if the first cut 601, the second cut 602 and/or the projection 8 extend both above, that is to say, towards the transversal wall 4, and below, that is to say, towards the free edge 304, the separating plane.

In fact, depending on the height of the projection 8 and/or of the cuts 601, 602, and on the position of the separating line 5, the projection 8 and/or the cuts 601, 602 may not be entirely axially contained in the retaining ring 301. The lateral wall 3 may comprise two zones 316, shown at least in FIGS. 4, 5 and 8, which extend parallel to the axis Z which have a first thickness S1, along a line perpendicular to the axis Z, which is less than a second thickness S2 of the lateral wall 3 positioned adjacent to them.

If the zones 316 are present, each cut 601, 602 is made in a respective zone 316.

In fact, each zone 316 defines, on the inside of the lateral wall 3, a respective angular portion which extends parallel to the axis Z for a predetermined dimension and which is shaped like a hollow relative to an inner surface of the lateral wall 3 adjacent to it.

Thanks to the fact that the first cut 601 and the second cut 602 are made in the respective zones 316 shaped like inner hollows, making the cuts 601, 602 themselves is simplified when the latter are made using operations for cutting the lateral wall 3 with suitable cutting tools, such as cutting blades.

In fact, the first thickness S1 being less than the second thickness S2, the cutting tools can more easily guarantee correct cutting of the entire thickness of the lateral wall 3 in the zones 316, without the need for abutting elements in contact with the inner surface of the lateral wall 3 itself.

The process for making the cap 1 is thereby simplified.

As already indicated, the retaining portion 303 is configured to keep the retaining ring 301 anchored to the neck 201 of the container 2 and extends as far as the free edge 304.

The retaining portion 303 comprises an engaging element 313 configured to internally engage with the stop ring 206 of the neck 201, during a passage from the closed condition to an open condition of the closing element 302. The engaging element 313 comprises an engaging wall which is bent around the free edge 304 and projects inwards in the cap 1.

The engaging wall is shaped like a sector of an annular wall and may be interrupted.

In fact, the engaging wall is provided with a plurality of projecting elements 313', shaped like flaps, whose length is such that they can engage with the stop ring 206, during the passage to the open condition of the closing element 302.

Alternatively, the engaging wall 313 may be continuous.

The free portion 306, which also extends as far as the free edge 304, is delimited by the free edge 304 itself, in the sense that there is a complete absence of any engaging wall (or the projecting elements 313') projecting from the free edge 304 inwards in the cap 1.

In this way, the axial movement of the third angular portion γ along an axis parallel to the axis Z is guaranteed.

Alternatively, according to one embodiment not shown, the free portion may comprise a respective plurality of projecting elements, not illustrated, which may be bent around the free edge 304 and may project from free edge 304 itself, whose respective length may be such that they do not engage with the stop ring 206 during the passage to the open condition of the closing element 302.

In this way, despite the presence of the projecting elements of the free portion 306, the axial movement of the second angular portion β of the retaining ring 301 is still allowed.

It should be noticed that the length of the projecting elements 313' is measured as the distance from the free edge 304. If present, the projecting elements of the free portion 306 are therefore shorter than those of the engaging wall in such a way that, during the passage from the closed condition to the open condition, when the projecting elements 313' engage with the stop ring 206, the projecting elements of the free portion (if present) cannot intercept the latter. The projecting elements of the free portion 306 (if present) could, for example, have delayed engagement with the stop ring 206 relative to the moment when the projecting elements 313' of the retaining portion 303, during the passage from the closed condition to the open condition, engage with the stop ring 206. Alternatively, the projecting elements of the free portion 306 could never intercept the stop ring 206, if it is preferable for the free portion 306 to be able to move without constraints relative to the stop ring 206.

According to a further embodiment, not shown, the engaging element 313 may comprise a plurality of protuberances which project from an inner surface of the retaining ring 301 and are configured to intercept the stop ring 206.

In this case, the free portion 306 is free of protuberances, so that it does not intercept the stop ring 206.

For example, in FIG. 5 the third angular portion γ extends for an angle equal to 190°. Therefore, it should be noticed that the free portion 306 is very extensive to define an extensive zone not retained by the stop ring 206.

Figure 9:
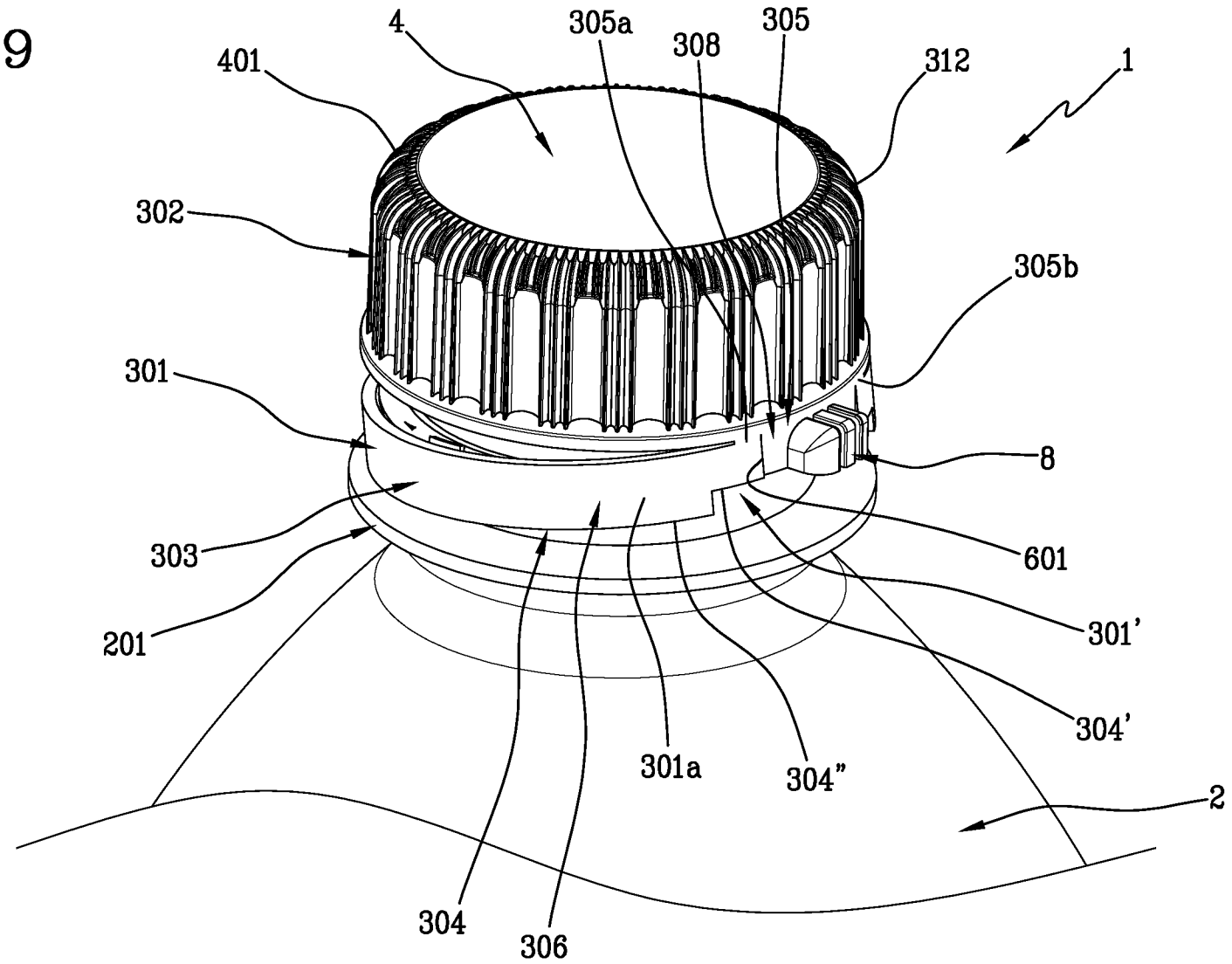
FIG. 9 is a perspective side view of the cap of FIG. 1, joined to the container, during the passage from the closed condition to the open condition.
Figure 10:
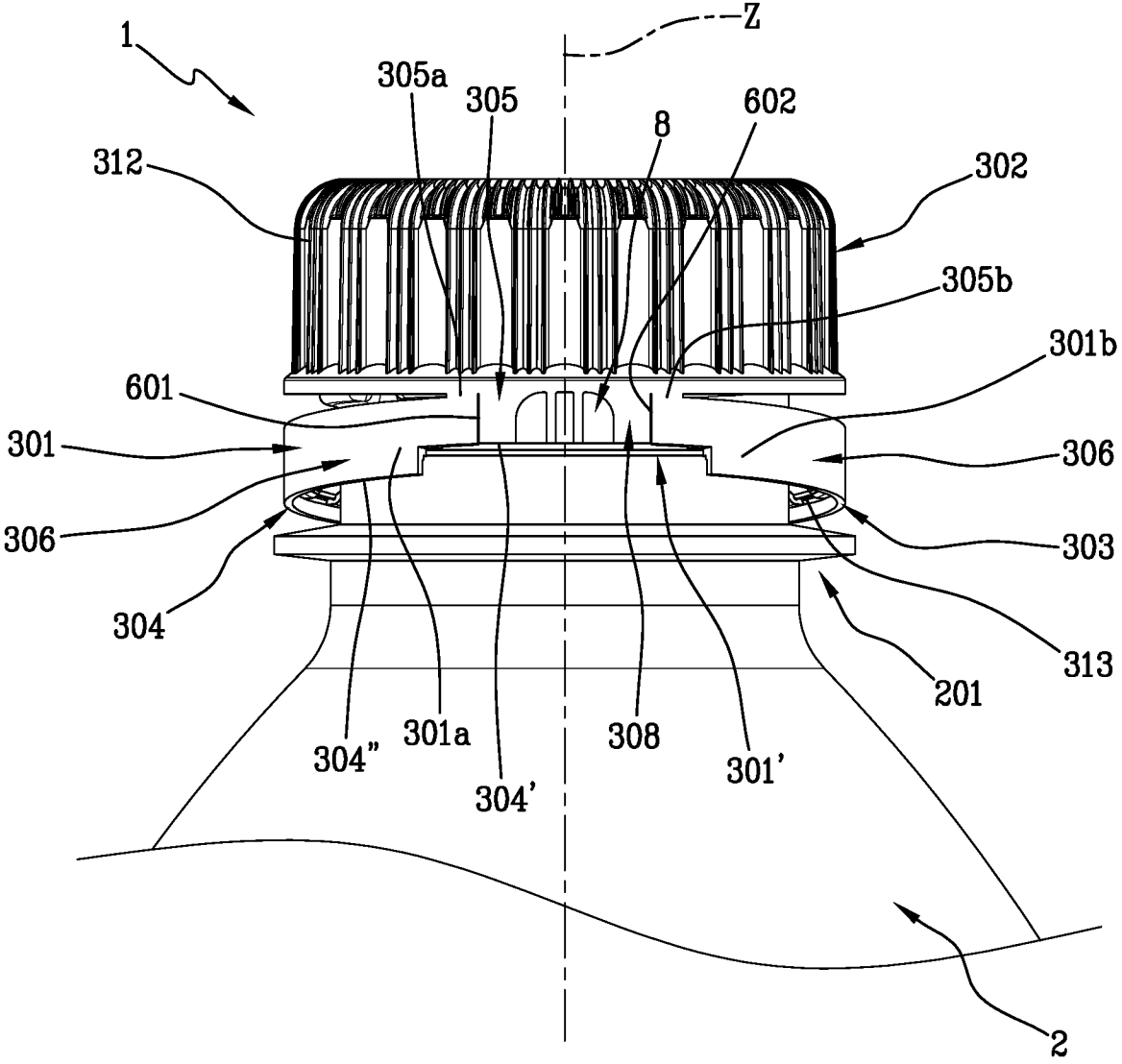
FIG. 10 is a front view of the cap of FIG. 1, joined to the container, during the passage from the closed condition to the open condition of FIG. 9.

As shown in FIGS. 9 and 10, the first angular portion α defined by the joining zone 305 is interposed, in the retaining ring 301, between a first free part 301*a* and a second free part 301*b* of the free portion 306, which are circumferentially positioned on opposite sides of the first angular portion α and are immediately adjacent respectively to the first end 501 and to the second end 502 of the separating line 5.

The first free part 301*a* and the second free part 301*b* define a hinge arrangement which has a capacity for movement, along an axial line, noticeably greater than the capacity for movement which would be allowed by the retaining portion 303 alone. That hinge arrangement makes it possible to move the closing element 302 away from the retaining portion 303 of the retaining ring 301 along a significant axial distance, determined by the length of the first free part 301*a* and of the second free part 301*b*, which are axially deformable.

In fact, as can be seen in FIGS. 9 and 10, the first free part 301*a* and the second free part 301*b* of the free portion 306 may be angled following the closing element 302 which moves away from the neck 201 of the container 2 to connect the closing element 302 to the retaining portion 303, which is stopped by the stop ring 206. The closing element 302 can easily be disengaged from the neck 201 of the container 2, since it is possible to make use of the capacity for axial movement of the free portion 306.

It should be noticed that the first free part 301*a* and the second free part 301*b* may have different lengths, if the free portion 306 is not centred relative to a median line M' of the joining zone 305.

Advantageously, the median line M' of the joining zone 305 shown in FIGS. 6 and 8, along a line parallel to the axis Z, is positioned circumferentially in a suitable position.

In fact, considering a reference angular portion λ with an amplitude equal to 60° which has a bisector plane BP which is defined by a first axis T, parallel to the axis Z, which is placed at the start 314*a* of the inner thread structure 314, and by a second axis B which is diametrically opposed to the first axis T, the median line M' of the joining zone 305 is positioned circumferentially within that reference angular portion λ.

The median line M' of the joining zone 305 defines two portions with equal circumferential extent between the first end 501 and the second end 502 of the of the joining zone 305.

In other words, if we now consider the schematic illustration in FIG. 6 and imagine a prism shaped like a slice of cake having as bases two circular sectors with extent equal to a reference angle of 60°, parallel to each other, having as the vertex the axis Z, and if that prism has as the bisector plane BP that defined by the first axis T and by the second axis B, the median line M' may be circumferentially positioned within the reference angular portion A of the lateral wall 3.

Preferably the reference angular portion λ has an amplitude which is equal to 40°.

According to one embodiment not shown, the cap may comprise a median line M which can also be positioned in the bisector plane BP, that is to say, it may coincide with the second axis B, diametrically opposed to the first axis T, or a median line M" positioned in a different angular position.

However, as schematically illustrated in FIG. 6 and as shown in FIG. 8, the median line M' does not lie in the bisector plane BP, but is shifted relative to it despite being contained within the reference angular portion previously defined.

Thanks to the fact that the median line M' of the joining zone 305 is substantially diametrically opposed to the start 314*a* of the inner thread structure 314 (or in any case may extend within the reference angular portion, the engagement between the start 314*a* of the inner thread structure 314 and the outer thread structure 205 of the neck 201 occurs in a position which is substantially diametrically opposed to the joining zone 305. A user, who wants to return the cap 1 to the closed condition after having opened it and has placed the closing element 302 over the supply opening 202, is in the condition in which the joining zone 305, which keeps the closing element 302 connected to the retaining ring 301, applies a direct tension along the axis Z in a region of the cap 1 which extends circumferentially even beyond the joining zone 305. Since the engagement between the inner thread structure 314 and the outer thread structure 205 occurs on the opposite side to the median line M' of the joining zone 305, or in any case within the reference angular portion λ, it is guaranteed that the user can freely angle the closing element 302 to search for that engagement without the movement being prevented by the axial tension of the joining zone 305. Therefore, user reclosing of the container 2 after having opened it is made easier.

The projection 8 may be positioned centrally in the joining zone 305. In other words, the median line M' of the joining zone 305 may coincide with the median line of the projection 8.

It should be noticed that the height of the projection 8, along an axis parallel to the axis Z, may be constant along an entire width of the projection around the axis Z, that is to say, for an angular extent of the projection around the axis Z, or the projection 8 may have a height which is variable around the axis Z.

In the closed position, a length of the projection 8 is measured along a line transversal, in particular perpendicular to the axis Z, that is to say, radially if we consider that the lateral wall 3 has a cylindrical shape.

Therefore, the projection 8 projects from the lateral wall 3 for a length which may be variable for its width, that is to say, along the entire angle of extension of the projection 8 around the axis Z, to define a projection 8 having an end wall 8*a* with the desired shape, which for the cap 1 is for example convex as shown in the accompanying figures.

According to one embodiment not shown, the shape of the end wall may be concave, or planar.

The projection 8 may have a plurality of portions which are positioned around the axis Z, wherein several first portions 8' have a predetermined length, which may vary around the axis Z, and other second portions 8" have a length equal to 0 and are positioned between two first portions 8' having predetermined length, in such a way that the projection 8 has an end wall 8*a* which is interrupted, but which as a whole has the desired shape.

In order for it to have the convex and interrupted shape shown in the accompanying figures, each first portion 8' has a length which may be angularly variable. Even the height of each first portion 8' may be variable along an axis parallel to the axis Z.

However, alternatively, according to a further variant not shown, each first portion 8' may have a respective straight end wall of the end edge, however with variable length for the different first portions 8'.

In the second portions 8" with length equal to 0, the projection 8 has zones in which it is angularly absent.

That is advantageous since it is a saving in terms of plastic material, although still keeps the projection 8 sturdy, so as to keep down production costs. The absence of plastic material in the second portions 8" also allows, when the projection 8 is made by moulding, rapid cooling of the first portions 8' and therefore rapid stabilisation of the cap 1 itself after the moulding. According to one embodiment not shown, the projection 8 may be made without interruptions.

The projection 8 has rounded, or radiused edges between the upper wall 8*b* and the end wall 8*a*, and/or between the end wall 8*a* e la lower wall 8*c* and/or between the end wall 8*a* and the lateral walls 8*d*, to improve the ergonomics of the projection 8 and to avoid sharp edges which could cause troublesome sensations for the user.

The width of the of the projection 8 around the axis Z is preferably greater than the height of the projection 8 along an axis parallel to the axis Z. However, the height and/or the width and/or the length of the projection 8 can be selected in an appropriate way as indicated below.

In fact, the position of the projection 8, and also the height of the projection 8 determine a positioning of the projection 8 on the neck 201. In fact, the projection 8 may make contact with the stop ring 206, as shown in FIG. 11, but could also be positioned above the stop ring 206, for example resting on the outer thread structure 205, or below the stop ring 206.

The height of the projection 8, measured along an axis parallel to the axis Z, may be, for example, greater than or equal to 1 mm and less than or equal to 4.5 mm and may be selected in a way suitable for determining the position in which the projection 8 makes contact with the neck 201.

The width of the projection 8 around the axis Z may be greater than or equal to 4° and less than or equal to 50°.

The length of the projection 8 measured along a line perpendicular to the axis Z, in the closed condition, may be greater than 0.5 mm, and less than or equal to 5.0 mm in particular preferably equal to 3.0 mm.

The first angular portion α defined by the joining zone 305 is greater than or equal to 20° and less than or equal to 120°, preferably it is greater than or equal to 25° and less than or equal to 90°.

The second angular portion β defined between the first cut 601 and the second cut 602 is greater than or equal to 10° and less than or equal to 70°, preferably between 25° and 55°.

The third angular portion γ defined by the free portion 306 is greater than or equal to 30° and less than or equal to 210°, preferably between 60° and 190°.

The fourth angular portion ε defined by the recess 301' is greater than or equal to 20° and less than or equal to 120°, preferably between 25° and 90°, even more preferably between 40° and 80°.

With the angular amplitudes indicated above the free portion 306 extends enough to define at the sides of the tab 308, defined by the first cut 601 and by the second cut 602 and containing the projection 8, the first free part 301*a* and the second free part 301*b* capable of allowing axial freedom of movement for the closing element 302 without compromising retention by means of the retaining portion 303, which in any case still extends enough to anchor the retaining ring 301 to the neck 201 of the container 2.

In use, at the end of a moulding procedure, a cup-shaped body is obtained, not shown, which has a lateral wall which extends from a transversal wall 4 as far as a free edge 304.

The free edge 304 delimits the cap 1 on the opposite side to the transversal wall 4 and extending beyond it there is a first panel intended to form an engaging element 313 of the retaining portion 303, when said first panel is bent inwards in the cap 1 around the free edge 304. A free portion 306 is delimited by the free edge 304, and extends circumferentially at least for a third angular portion γ. Alternatively, a second panel may be present, intended to form the free portion 306, which when it is bent around the free edge 304 forms the projecting elements of the free portion 306 (if present). The moulding procedure is also used to obtain a projection 8 which projects from the lateral wall 3.

According to one preferred embodiment of the cap 1, there is a step of cutting the cup-shaped body comprising a first step of cutting the lateral wall 3, to obtain a separating line 5, capable of defining a retaining ring 301 and a closing element 302 of the cap 1, and a second cutting step, to obtain a first cut 601 and a second cut 602 between which the projection 8 is positioned in the cap 1.

In order to carry out the cutting step, there is a cutting unit (not illustrated) comprising cutting tools, which may for example be blades positioned perpendicularly to the axis Z, to make the separating line 5, or blades positioned parallel to the axis Z to make the first cut 601 and the second cut 602.

The cutting unit is positioned downstream of the mould in which the cup-shaped body is formed.

The blades, for example circular or linear, can interact with the lateral wall 3 from the outside of the latter, or from the inside. Moreover, the cup-shaped body can be rotated around the axis Z, while the blades are held in position, so as to make consecutive zones of the lateral wall 3 interact, in sequence, with the blades; or it is also possible to hold the cup-shaped body in position and to rotate the blades.

It should be noticed that, since the projection 8 is made by moulding and is already present in the cup-shaped body during the cutting step, it is necessary to carry out the first cutting step and the second cutting step in a suitable way, so that, in the cap 1, the projection 8 is positioned in the second angular portion β, between the first cut 601 and the second cut 602, and in turn the first cut 601 and the second cut 602 are positioned in the first angular portion α.

In other words, given a position of the projection 8 in the cup-shaped body, it is necessary for the cutting step to be synchronised with it.

The cutting unit comprises a spindle configured to retain the cup-shaped body and to bring the cup-shaped body into contact with the blades of the cutting unit. For example, the spindle may have a head end configured to be received inside the cup-shaped body.

If the blades are held in position, the spindle can be fixed to a rotary carrousel and can be configured to cause the rotation of the concave body in which it is received, simultaneously pushing it towards the blades.

In order to synchronise the cutting step with the position of the projection, the cup-shaped body is provided with a timing element (not illustrated), positioned inside the cup-shaped body and positioned in the known way relative to the projection 8.

The spindle is also provided with a respective timing component, which is configured to couple to the timing element of the cup-shaped body, in such a way that the head end of the spindle is received in the spindle in a well-defined angular phase.

Therefore, it should be noticed that, even if the cup-shaped body is fed to cutting unit without constraints on orientation, it is driven to rotate by the spindle in an oriented way since the coupling between the head end of the spindle and the cup-shaped body determines the orientation of the self-same cup-shaped body, which is therefore positioned in a reference angular phase before the cutting step begins.

The subsequent cutting step is therefore carried out angularly synchronised relative to the position of the projection 8, or of any other reference present in the cup-shaped body.

A method and a cutting unit for carrying out processing in the form of cuts synchronised with the cup-shaped body is shown in more detail in European application EP4008503, to which reference is made without limiting the general scope of the invention.

After the cup-shaped body has been formed, it is applied on the neck 201 of the container 2 in the closed condition shown in FIG. 1, thereby defining the cap 1, and is positioned in such a way that the engaging element 313 provided inside the retaining ring 301, in particular on the retaining portion 303, is below the stop ring 206 present on the neck 201.

When the user wishes to open the container 2 for the first time, the user grips the closing element 302 and rotates the closing element 302 around the axis Z, in order to unscrew the closing element 302 from the neck 201.

During the passage from the closed condition to the open condition, initially, the closing element 302 and the retaining ring 301 are rotated together around the axis Z, and they simultaneously move together along a line parallel to the axis Z, away from the neck 201.

This occurs until the engaging element 313 of the retaining portion 303 abuts against the stop ring 206 provided on the neck 201. At this point, the stop ring 206 prevents the retaining portion 303 from rising further along the axis Z, acting as a stop for the movement of the retaining portion 303, and therefore of the retaining ring 301, away from the neck 201. The free portion 306, delimited by the free edge 304, allows a facilitated movement along an axis parallel to the axis Z in the third angular portion γ, and can continue to follow the joining zone 305 and the closing element 302 away from the neck of the container 2.

The closing element 302, which is unscrewed when the user engages the inner thread structure 314 of the cap 1 with the outer thread structure 205 of the neck 201, continues to move along the axis Z away from the neck 201 and also drags the free portion 306 with it. The breakable bridges 503 are thereby tensioned, until causing them to break. The closing element 302 consequently separates from the retaining ring 301 along the separating line 5, but remains joined to the retaining ring 301 at the joining zone 305. The first free part 301*a* and the second free part 301*b* of the free portion 306 of the retaining ring 301 are angled following the closing element 302 and in this way they connect the closing element 302 to the retaining portion 303, which is stopped by the stop ring 206.

If the user continues unscrewing the closing element 302, in such a way as to further move the closing element 302 along the axis Z so as to remove it from the neck 201, the first free part 301*a* and the second free part 301*b* further deform and the projection 8, together with the first cut 601 and the second cut 602, move away from the stop ring 206 whilst the first free part 301*a* and the second free part 301*b* are pulled upwards and are angled relative to the stop ring 206 converging towards the joining zone 305.

Continuing to unscrew the closing element 302, the latter disengages from the outer thread structure 205 formed on the neck 201, so that the container 2 can be opened. In contrast, the retaining portion 303 of the retaining ring 301 remains anchored to the neck 201.

In order to be able to completely disengage the closing element 302 from the neck 201 of the container 2, the user moves the closing element 302 further away from the neck 201 in such a way as to be able to rotate it. In fact, the joining zone 305 defines a hinge band, which keeps the closing element 302 connected to the neck 201 and around which the closing element 302 can rotate moving away from the neck 201.

In this way, the closing element 302 can be shifted into a position at the side of and at a distance from the neck 201, as shown in FIG. 11, until the projection 8 is resting on the neck 201.

During the rotation of the closing element 302, the tab 308 defined between the first cut 601 and the second cut 602 can rotate relative to adjacent portions of the retaining ring 301 to allow the projection 8 to adapt more to the shape of the neck 201 of the container 2. The first hinge element 305*a* and the second hinge element 305*b*, positioned at the sides of the respective cuts 601, 602, deform to allow the rotation of the projection 8. If present, the breakable elements 603, 604, positioned between the respective cuts 601, 602 and the free edge 304, are intended to break.

If the retaining ring 301 comprises the recess 301', which extends at least in the second angular portion β defined between the first cut 601 and the second cut 602, projection 8 resting on the neck 201 in the open condition is facilitated since a lower wall 8*c* of the projection 8 is positioned near the first stretch 304' of the free edge 304, and is set back relative to the second stretch 304" of it, which defines the recess 301'.

The first hinge element 305*a* and the second hinge element 305*b*, positioned at the sides of the respective cuts 601, 602 deform and the end wall 8*a* of the projection 8 intercepts the neck 201; that prevents the closing element 302 from being able to accidentally rotate again towards the neck 201 and around it since rotation of the projection 8 is stopped by the neck 201 itself.

After use, the user can return the cap 1 from the open condition to the closed condition shown in FIG. 1 by means of a sequence of operations in reverse order compared with what was previously described.

To disengage the projection 8 from the stop ring 206, the user must first move the closing element 302 away from the neck 201, by pulling the closing element 302 upwards and further deforming the first free part 301 a and the second free part 301*b*.

In fact, the user can disengage the projection 8 from the stop ring 206 by making the end wall 8*a* of the projection 8 slide on an upper wall of the stop ring 206 itself.

Then, the user can reapply the closing element 302 on the neck 201, by rotating the closing element 302 around the joining zone 305 and moving the closing element 302 towards the neck 201, before screwing the closing element 302 back onto the outer thread structure 205 of the neck 201.

When the closing element 302 is aligned with the supply opening 202 the first free part 301*a* and the second free part 301*b* of the retaining ring 301 are again positioned in a configuration angled relative to the retaining portion 303 and they converge in the joining zone 305, to which the closing element 302 is joined, again adopting the trapezium-shaped configuration. To screw the cap 1 back onto the neck 201, the user must engage the inner thread structure 314 of the closing element 302 on the neck 201, starting from the start 314*a* which is located near the separating line 5.

Thanks to the fact that said start 314*a* is substantially diametrically opposed to the median line M' of the joining zone 305, that is to say, the median line M' is positioned around the lateral wall 3 within the reference angular portion A equal to 60°, preferably 40°, whose bisector plane BP is defined by the first axis T and by the second axis B, which is diametrically opposed to B, the user engaging the inner thread structure 314 of the closing element 302 with the outer thread structure 205 of the neck 201 is made easier since at the first axis T, that is to say, at the start 314*a* of the inner thread structure 314, it is possible to use the maximum freedom of positioning in space of the closing element 302.

With regard to the plastic material used to make the cap 1, the following should be noticed.

If PE is used, its density may range from low density to high density. In particular, it is possible to use high density polyethylene (HDPE). The high density polyethylene (HDPE) used to make the cap previously described may have the following properties:

density variable between 950 and 968 kg/m3;

melt index variable from 0.3 to 20 g, in the following measuring conditions: 10 minutes, 190° C., 2.16 kg;

molecular weight distribution wide, or narrow, or unimodal, or multimodal.

If PP is used, that material may be in the form of a homopolymer, or heterophasic copolymer, or even statistical copolymer.

The melt index of PP may vary from 2 to 20 g, in the following measuring conditions: 10 minutes, 230° C., 2.16 kg.

This invention is advantageously applicable to a cap 1, which is suitable for use, for example, on necks 201 in the following list, each neck 201 being associated with a respective code which identifies the name of the neck 201, the diameter of the outer surface of the neck 201, and the diameter of the supply opening of the neck 201, in accordance with the nomenclature of CETIE (www.cetie.org)) or ISBT (www.bevech.org).

For each code, if the neck 201 is also a European standard, the reference number is also provided.

| | |
|---|---|
| GME30.39 25/22 mm | |
| GME30.28 26/22 mm | DIN EN 16594: 2016 |
| GME30.38 26/22 mm | |
| GME30.37 26/22 mm | |
| GME30.40 26/22 mm | |
| GME30.24 27/22 mm | EN 16067: 2012 |
| PCO1881 28/22 mm | |
| PCO1810 28/22 mm | |
| GME30.26 29/25 mm | EN 16592: 2015 |
| GME30.21 30/25 mm | EN 16064: 2012 |
| GME30.31 32/26 mm | |
| GME30.36 32/27 mm | |
| GME30.30 33/28 mm | |
| GME30.25 38/33 mm | |
| GME30.29 38/32 mm | |

The invention claimed is:

1. A closing cap (1) for a container (2), comprising a lateral wall (3) extending around an axis (Z) and a transversal wall (4) positioned at one end of the lateral wall (3), a separating line (5) being provided on the lateral wall (3) to define a retaining ring (301), which is configured to remain anchored to the neck (201) of the container (2), and a closing element (302) removably engageable with the neck (201), so as to open or close the container (2); wherein the separating line (5) extends around the axis (Z) and is circumferentially interrupted to define in the lateral wall (3) a joining zone (305), which extends circumferentially for a first angular portion (α), in which the retaining ring (301) and the closing element (302) are joined; wherein the lateral wall (3) comprises a first cut (601), a second cut (602) and a projection (8), which projects from the lateral wall (3) and is configured to rest on the neck (201) in an open condition, wherein the first cut (601) and the second cut (602) extend circumferentially within a second angular portion (β) which is contained in the first angular portion (α) and the projection (8) is circumferentially positioned between the first cut (601) and the second cut (602); wherein the retaining ring (301) comprises a retaining portion (303) and a free portion (306), wherein both the retaining portion (303) and the free portion (306) extend as far as a free edge (304), the retaining portion (303) being configured to internally engage with a stop ring (206) of the neck (201), during a passage from a closed condition to an open condition of the closing element (302); the free portion (306) being configured to allow an axial movement at least of the second angular portion (β) of the retaining ring (301) during said passage, wherein each cut (601; 602) is formed by a cutting line passing through the lateral wall (3) and extends as far as the free edge (304) to define a tab (308) within which the projection (8) is positioned.

2. The cap according to claim 1, wherein the retaining ring (301) comprises a recess (301') which extends circumferentially for a fourth angular portion (ε), containing the second angular portion (β), to facilitate resting of the projection (8) on the neck (201) in the open condition.

3. The cap according to claim 2, wherein the fourth angular portion (ε) defined by the recess (301') is greater than or equal to 20° and less than or equal to 120°.

4. The cap according to claim 2, wherein the free portion (306) extends circumferentially for a third angular portion (γ), which contains at least the second angular portion (β); and wherein the size of the fourth angular portion (ε) is less than or equal to the third angular portion (γ).

5. The cap according to claim 4, wherein the third angular portion (γ) defined by the free portion (306) is greater than or equal to 30° and less than or equal to 210°.

6. The cap according to claim 1, wherein along a line parallel to the axis (Z) the height of the first cut (601) and the second cut (602) is at least equal to a height of the projection (8), wherein in particular the first cut (601) and the second cut (602) extend along the line parallel to the axis (Z).

7. The cap according to claim 1, wherein the lateral wall comprises two zones (316) which extend parallel to the axis (Z), which have a first thickness (S1), along a line perpendicular to the axis (Z), which is less than a second thickness (S2) of the lateral wall (3) positioned adjacent to them, wherein each cut, of the first cut (601) and the second cut (602), is made in a respective zone (316).

8. The cap according to claim 1, wherein the retaining portion (303) comprises an engaging element (313) configured to internally engage with the stop ring (206) of the neck (201), wherein the engaging element (313) comprises an engaging wall which is bent around the free edge (304) and projects inwards in the cap (1); wherein the engaging wall is provided with a plurality of projecting elements (313'), shaped like flaps, whose length is such that they can engage with the stop ring (206), during the passage to the open condition of the closing element (302).

9. The cap according to claim 1, wherein the free portion (306) extends as far as the free edge (304) and is delimited by it; or wherein the free portion (306) comprises a plurality of projecting elements which are bent around the free edge (304) and project inwards in the cap (1), the length of the projecting elements of the free portion (306) being such that they do not engage with the stop ring (206) during the passage to the open condition of the closing element (302).

10. The cap according to claim 1, and comprising an inner thread structure (314), positioned on the inside of the lateral wall (3) and configured to engage with an outer thread structure (205) of the neck (201) in such a way as to removably couple the closing element (302) to the neck (201) of the container (2), the inner thread structure having a start (314*a*) placed near the separating line (5); wherein a median line (M') of the joining zone (305), along a line parallel to the axis (Z), is positioned circumferentially within a reference angular portion (λ), wherein said reference angular portion (λ) has an amplitude which is less than or equal to 60° around the axis (Z) and has a bisector plane (BP), wherein the bisector plane (BP) is defined by a first axis (T), parallel to the axis (Z), placed at the start (314*a*) of the inner thread structure (314) and a second axis (B) which is diametrically opposed to the first axis (T), wherein the second axis (B) is located within the reference angular portion (λ) and the first axis (T) is located outside the reference angular portion (λ).

11. The cap according to claim 10, wherein said reference angular portion (λ) is equal to 40°.

12. The cap according to claim 1, wherein the first cut (601), the second cut (602) and/or the projection (8) are, at least partly, contained in the closing element (302) and in the retaining ring (301).

13. The cap according to claim 1, wherein the projection (8) projects from the lateral wall (3) outwards for a length measured along a line which is transversal, in particular perpendicular, to the axis (Z) in the closed position of the closing element (6), which is variable around the axis (Z) to define the projection (8) having an end wall (8*a*).

14. The cap according to claim 13, wherein the projection (8) comprises a plurality of portions which are positioned around the axis (Z), wherein the plurality of portions comprises several first portions (8') and several second portions (8''), wherein each of the several first portions (8') has a predetermined length, wherein the predetermined lengths of each of the several first portions (8') may vary around the axis (Z) such that each of the several first portions (8') have a predetermined length that is angularly variable along the first portions themselves and/or the predetermined lengths of at least two of the several first portions (8') are not equivalent, and the several second portions (8'') have a length equal to 0 and are positioned between two first portions (8'), in such a way that the projection (8) has the end wall (8*a*) which is interrupted, but which has a convex shape.

15. The cap according to claim 1, wherein the projection (8) extends around the axis (Z) for a respective angle greater than or equal to 4° and less than or equal to 50°.

16. The cap according to claim 1, wherein the projection (8) has a height, measured along a line parallel to the axis (Z), greater than or equal to 1.0 mm and less than or equal to 4.5 mm.

17. The cap according to claim 1, wherein the projection (8) projects from the lateral wall (3) for a length measured along a line transversal to the axis (Z) in the closed position of the closing element (6), which is greater than or equal to 0.5 mm and less than or equal to 5.0 mm.

18. The cap according to claim 1, wherein the first angular portion (α) defined by the joining zone (305) is greater than or equal to 20° and less than or equal to 120°.

19. The cap according to claim 1, wherein the second angular portion (β) defined between the first cut (601) and the second cut (602) is greater than or equal to 10° and less than or equal to 70°.

20. A closing cap (1) for a container (2), comprising a lateral wall (3) extending around an axis (Z) and a transversal wall (4) positioned at one end of the lateral wall (3), a separating line (5) being provided on the lateral wall (3) to define a retaining ring (301), which is configured to remain anchored to the neck (201) of the container (2), and a closing element (302) removably engageable with the neck (201), so as to open or close the container (2); wherein the separating line (5) extends around the axis (Z) and is circumferentially interrupted to define in the lateral wall (3) a joining zone (305), which extends circumferentially for a first angular portion (α), in which the retaining ring (301) and the closing element (302) are joined; wherein the lateral wall (3) comprises a first cut (601), a second cut (602) and a projection (8), which projects from the lateral wall (3) and is configured to rest on the neck (201) in an open condition, wherein the first cut (601) and the second cut (602) extend circumferentially within a second angular portion (β) which is contained in the first angular portion (α) and the projection (8) is circumferentially positioned between the first cut (601) and the second cut (602); wherein the retaining ring (301) comprises a retaining portion (303) and a free portion (306) which extend as far as a free edge (304), the retaining portion (303) being configured to internally engage with a stop ring (206) of the neck (201), during a passage from a closed condition to an open condition of the closing element (302); the free portion (306) being configured to allow an axial movement at least of the second angular portion (β) of the retaining ring (301) during said passage, wherein each cut (601; 602) is formed by a cutting line passing through the lateral wall (3), wherein each cut (601; 602) comprises a respective breakable element (603; 604), suitable for breaking when the cap (1) is opened for the first time to define a tab (308) within which the projection (8) is positioned.

21. The cap according to claim 20, wherein present between the free edge (304) and the first cut (601) there is a first breakable element (603), and present between the free edge (304) and the second cut (602) there is a second breakable element (604); or wherein the first breakable element (603) and the second breakable element (604) are respectively positioned along the first cut (601) and the second cut (602), at a distance from the free edge (304).

* * * * *